US005191866A

United States Patent [19]

Tosdale

[11] Patent Number: 5,191,866

[45] Date of Patent: Mar. 9, 1993

[54] THROTTLE CONTROL SYSTEM FOR AUTOMOTIVE VEHICLE

[75] Inventor: Thomas M. Tosdale, Livonia, Mich.

[73] Assignee: Ford Motor Company, Dearborn, Mich.

[21] Appl. No.: 891,115

[22] Filed: Jun. 1, 1992

[51] Int. Cl.[5] ..... F02D 7/00

[52] U.S. Cl. ..... 123/400; 123/342

[58] Field of Search ..... 123/400, 342, 396, 401

[56] References Cited

U.S. PATENT DOCUMENTS

| | | | |
|---|---|---|---|
| 1,473,754 | 11/1923 | Bailhe | 123/400 |
| 2,076,788 | 4/1937 | Leibing et al. | 123/400 |
| 3,063,526 | 11/1962 | Griffen . | |
| 3,923,020 | 12/1975 | Gilligan | 123/400 |
| 4,077,370 | 3/1978 | Spangelberg | 123/400 |
| 4,117,809 | 10/1978 | Kittler | 123/400 |
| 4,270,501 | 6/1981 | Breen et al. | 123/400 |
| 4,362,138 | 12/1982 | Krueger et al. | 123/400 |
| 4,530,326 | 7/1985 | Mann et al. | 123/400 |
| 4,543,932 | 10/1985 | Sturdy | 123/342 |
| 4,729,355 | 3/1988 | Barnes . | |
| 4,756,287 | 7/1988 | Sakakibara et al. | 123/342 |
| 4,811,809 | 3/1989 | Reinartz et al. | 123/400 |
| 4,834,044 | 5/1989 | Maas | 123/342 |
| 4,875,449 | 10/1989 | Kraemer et al. | 123/400 |
| 5,020,623 | 6/1991 | Machara | 123/400 |

*Primary Examiner*—Raymond A. Nelli

*Attorney, Agent, or Firm*—Jerome R. Drouillard; Roger L. May

[57] ABSTRACT

A throttle control system for an automotive vehicle includes a motion transmitting member having a length sufficient to extend between an accelerator pedal and a throttle crank so that depression of the accelerator will cause rotation of a throttle shaft attached to the crank. The motion transmitting member includes a provision allowing it to deflect so as to permit further movement of the accelerator pedal without further rotation of the throttle shaft once the throttle shaft has been moved to the wide open throttle position.

8 Claims, 3 Drawing Sheets

THROTTLE CONTROL SYSTEM FOR AUTOMOTIVE VEHICLE

BACKGROUND AND SUMMARY OF THE INVENTION

Automotive throttle control systems have traditionally used various resilient elements for controlling the position of the air throttle device.

U.S. Pat. No. 4,117,809 to Kittler discloses a spring mechanism for increasing the resistance against the opening of the throttle device as the accelerator pedal of the vehicle is depressed.

U.S. Pat. No. 4,875,449 to Kramer et al. discloses a multi-spring type device which prevents the throttle device from changing position during a portion of the travel of the throttle cable.

The present invention deals with the problem of preventing damage to the throttle control system in the event that the driver of the vehicle persists in depressing the accelerator pedal once the wide open throttle position has been achieved. According to the present invention, a motion transmitting member having a length sufficient to extend between the accelerator pedal and a crank means operatively associated with the throttle device will cause rotation of the throttle shaft and concurrent opening of the throttle device. Once the wide open throttle position has been achieved, a resilient means positioned in the motion transmitting member intermediate its ends will deflect so as to allow further movement of the accelerator pedal without further opening of the throttle device. In this manner, the problem of damage to the throttle control system due to overzealous drivers will be avoided.

DETAILED DESCRIPTION OF THE PREFERRED EMBODIMENTS

Figures 1, 2:
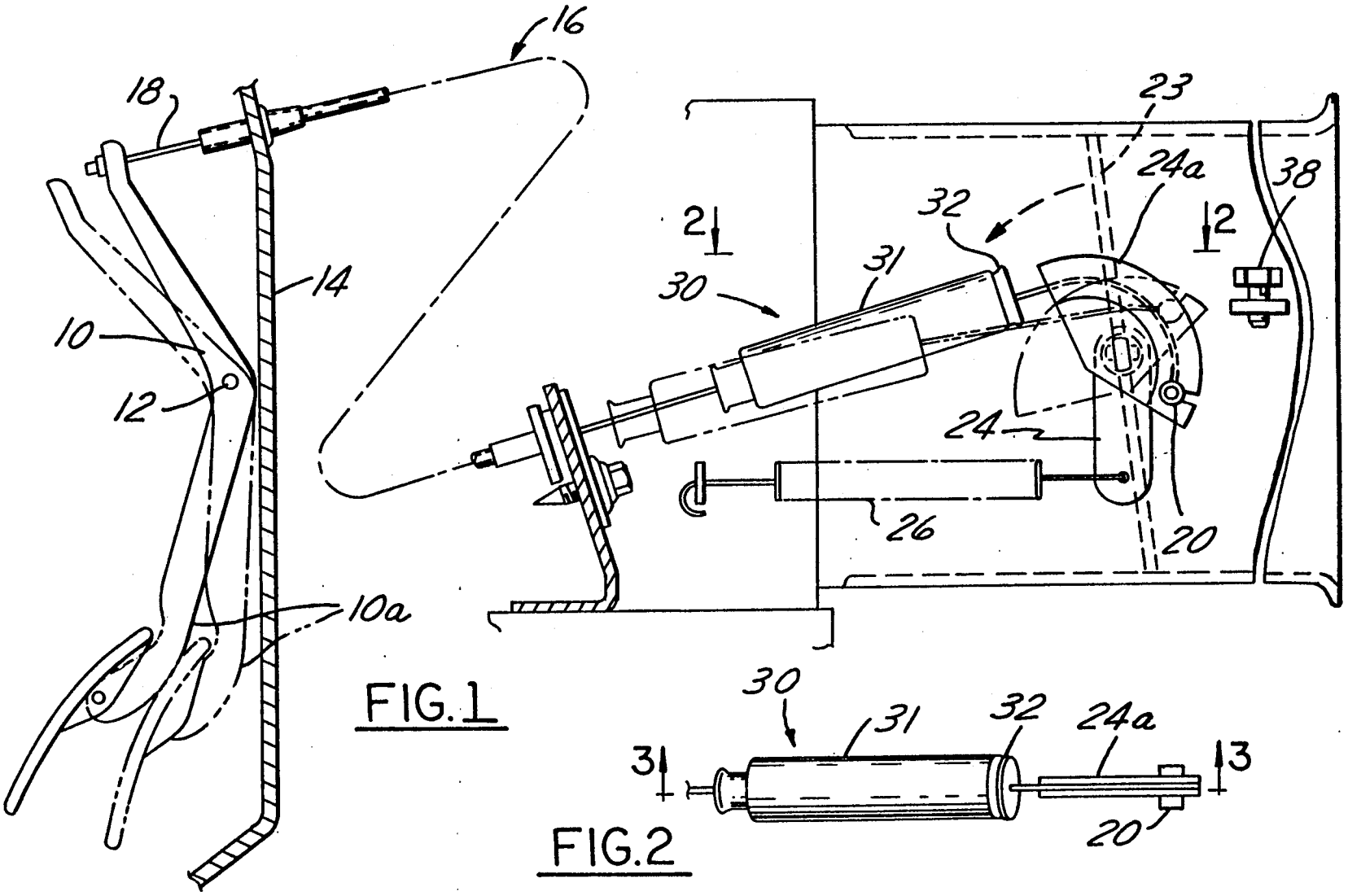
FIG. 1 is a schematic representation of a system according to the present invention.
FIG. 2 is a drawing of a cartridge according to the present invention taken along the line 2—2 of FIG. 1.

FIG. 1 illustrates a throttle control system according to the present invention in which an accelerator pedal assembly 10, is mounted on a pivot, 12, with the pivot being attached to the toe board, 14, of the vehicle. The purpose of this invention is to allow the lower part, 10*a*, of accelerator pedal 10 to come into contact with toe board 14 once the throttle mechanism has come to wide open throttle, but without deforming, or otherwise unduly stressing, the structure of either pedal 10 or pivot 12 or toe board 14. A flexible cable, 16, serves as a motion transmitting member extending between accelerator pedal 10 and a crank means, 24. Depression of accelerator pedal 10 will cause rotation of throttle shaft 22 which is attached rigidly to crank means 24. Similarly, throttle device 23, which is also affixed to throttle shaft 22, will be caused to rotate when accelerator pedal 10 is depressed.

Figure 3:
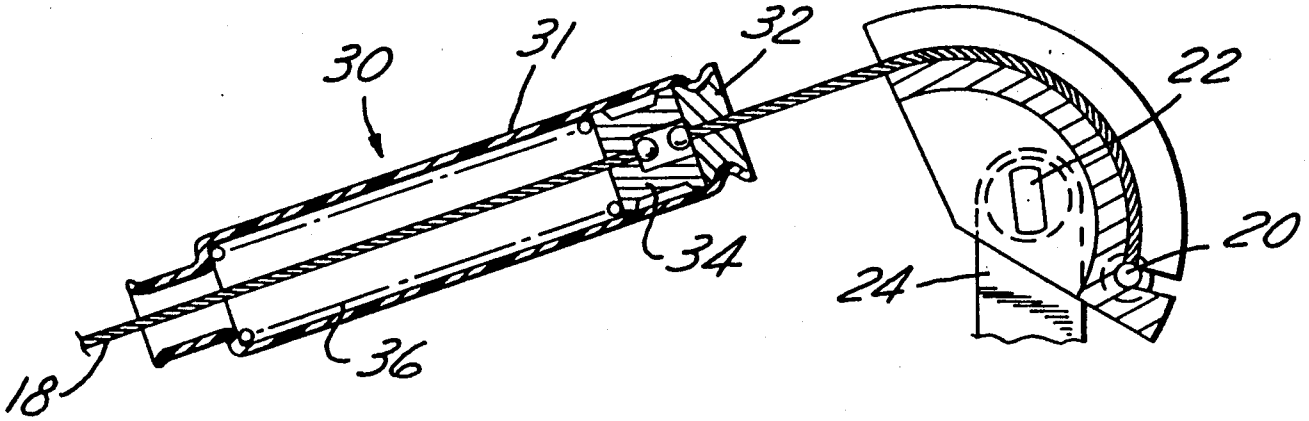
FIG. 3 is a section of the cartridge shown in FIG. 2 taken along the line 3—3 of FIG. 2.

Spring 26 serves to bias crank means 24 to the idle or closed throttle position. Conversely, throttle stop 38 serves to engage crank means 24 so as to prevent further opening of throttle device 23 when throttle shaft 22 has reached the wide open throttle position. As is further shown in FIG. 1, flexible cable 16 has a first end 18, attached to the accelerator pedal, and a second end 20, which is attached to sector 24*a* which comprises a part of crank means 24. As seen in FIGS. 1, 2, and 3, the second end 20 of flexible cable 16 is trained about quadrant 24*a* so as to unwind as the throttle is opened. A cartridge, 30, is provided according to the present invention to prevent damage to the throttle control system when accelerator pedal 10 is depressed beyond the wide open throttle position.

Once accelerator pedal 10 is sufficiently depressed such that crank means 24 comes into contact with throttle stop 38, throttle device 23 will be prohibited from opening further. When this condition is reached, accelerator pedal 10 will, however, be allowed to rotate until it contacts toe board 14 within the vehicle's passenger compartment because cartridge 30 will deflect, and in effect, increase its effective length so as to allow the accelerator pedal to move unaccompanied by further rotation of throttle shaft 22.

Details of construction of cartridge 30 are shown in FIG. 3. Notice that first end 18 of flexible cable 16 is attached to a plunger, 34, which is slidably mounted within a cylindrical body, 31. The plunger is biased to a short cable position by means of spring 36. Spring 36 is selected to have a spring rate of sufficient magnitude so that spring 36 will not be compressed to any significant degree when crank means 24 is not in contact with throttle stop 38. Once such contact is made, further rotation of accelerator pedal 10 will cause plunger 34 to move along a length of cylindrical body 31 sufficient to allow portion 10*a* of the accelerator pedal to come into contact with toe board 14. Thus, spring 36, which tends to shorten the effective length of the motion transmitting member, will, in effect, have allowed the length of the member to increase. Cable 16 may thus be viewed as an inextensible means serially linked with an extensible means, cartridge 30, such that the length of the extensible means increases in response to movement of accelerator pedal 10 past the point at which wide open throttle is reached.

Figure 4:
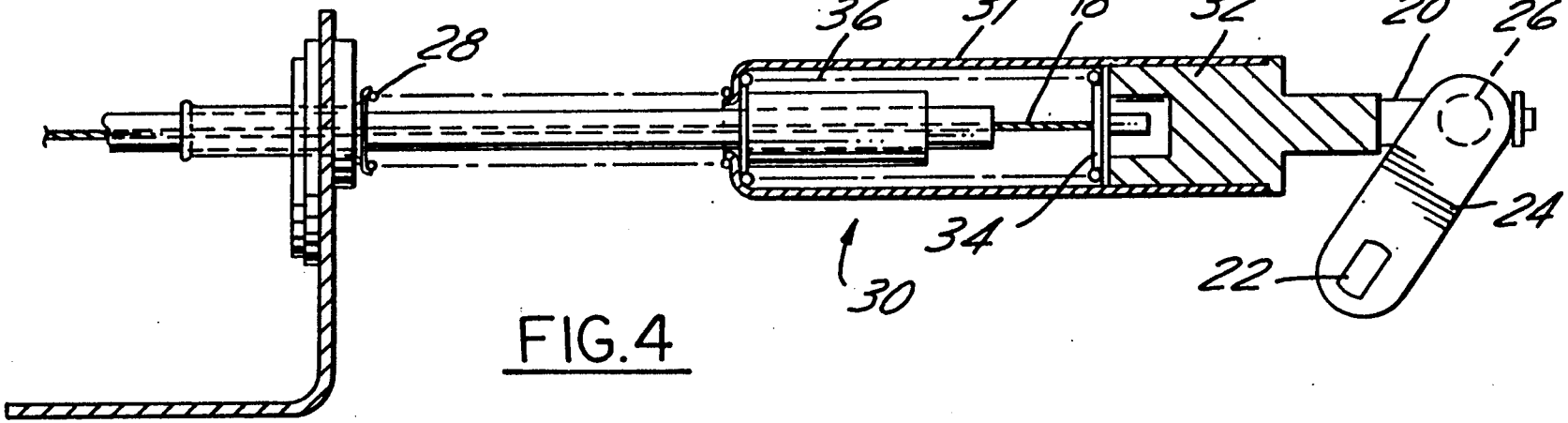
FIGS. 4, 5, and 6 are sectional views of a second embodiment according to the present invention, shown in various operating positions.
Figure 5:
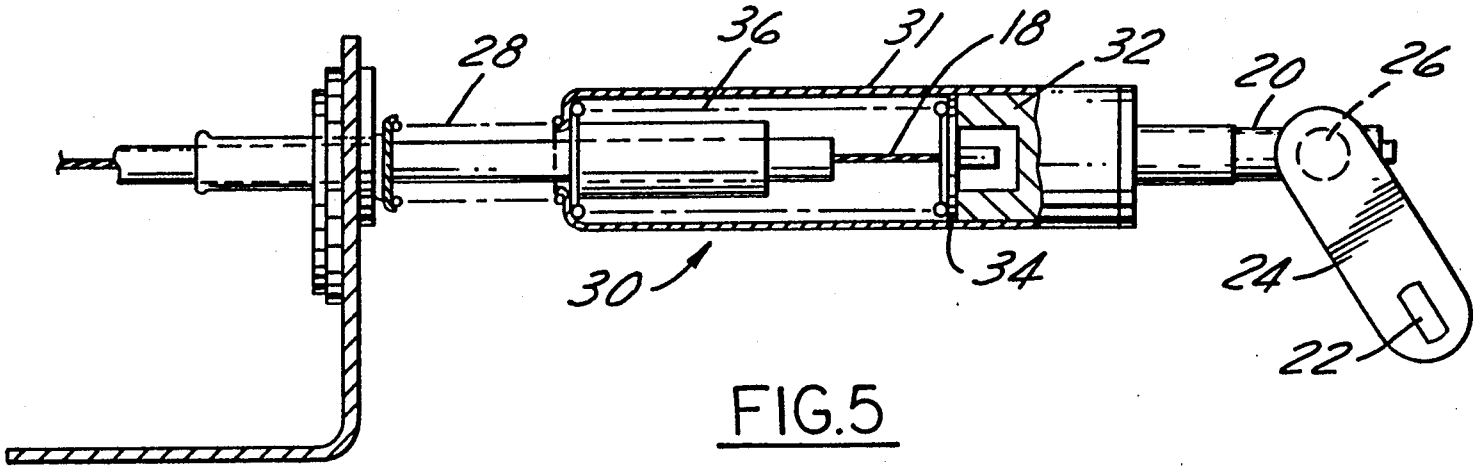
Figure 6:
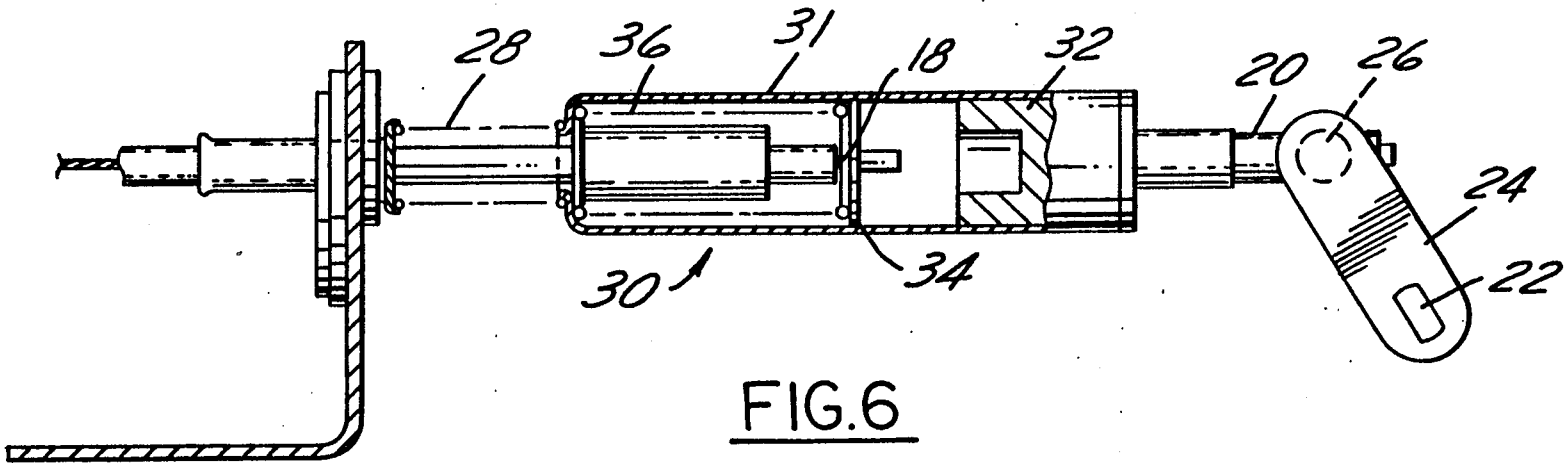

FIGS. 4, 5, and 6 illustrate a second embodiment of the present invention. The second end, 20, of flexible cable 16 is attached by means of a swivel joint, 26 to crank means 24. As with the first embodiment, cartridge 30 includes a generally cylindrical body, 31, having a closed end, 32, attached to second cable end 20 and housing a resilient element, which in this case comprises spring 36. The length of flexible cable 16 is controlled by cartridge 30 so that the length of the cable will remain relatively constant upon depression of the accelerator pedal until the point is reached at which throttle shaft 22 has reached the wide open throttle position, whereupon the length of the spring 36 will decrease as it is depressed by plunger 34, thereby causing an increase of the effective length of cartridge 30 so that further rotational movement of pedal 10 will be unaccompanied by further rotation of throttle shaft 22. Note that the embodiment of FIGS. 4, 5, and 6 includes a compression spring, 28 which serves to return crank means 24 to the idle position once the accelerator pedal is released.

Those skilled in the art will appreciate in view of this disclosure that the resilient element employed within cartridge 30 according to the present invention could comprise not only the illustrated spring means, but also other types of resilient means such as suitable elastomeric compounds. Further, the resilient element may incorporate known pneumatic or hydraulic motion damping devices.

I claim:

1. A throttle control system for an automotive vehicle, comprising:

an accelerator pedal;

a rotatable throttle shaft having a crank means and a throttle device affixed thereto, with said shaft being rotatable from an idle position to a wide open throttle position;

a first spring means for biasing said crank means to an idle position;

stop means for engaging said crank means and for preventing further opening of the throttle device when the throttle shaft has reached the wide open throttle position; and a motion transmitting member having a length sufficient to extend between said accelerator pedal and said crank means such that depression of the accelerator will cause rotation of the throttle shaft and concurrent opening of said throttle device, with said motion transmitting member comprising a first end operatively engaged with said accelerator pedal, a second end operatively engaged with said crank means, and a second spring means, positioned intermediate the first and second ends, for deflecting so as to allow further movement of the accelerator pedal without further opening of the throttle device once the throttle shaft has been moved to the wide open throttle position.

2. A throttle control system according to claim 1, in which the accelerator pedal is mounted within a passenger compartment of said vehicle such that the spring means will allow the pedal to rotate until it contacts a toe board within said compartment.

3. A throttle control system according to claim 1, in which said first and second ends comprise flexible cable elements, and the second spring means comprises a generally cylindrical body having a closed end attached to the second cable end and further comprising a spring-biased plunger housed within said cylinder and having the first cable end attached to said plunger such that the spring will tend to shorten the effective length of the motion transmitting member.

4. A throttle control system for an automotive vehicle, comprising:

an accelerator pedal;

a rotatable throttle shaft having a crank means and a throttle device affixed thereto, with said shaft being rotatable from an idle position to a wide open throttle position;

a spring means for biasing said crank means to an idle position;

stop means for engaging said crank means and for preventing further opening of the throttle device once the throttle shaft has reached the wide open throttle position; and motion transmitting means extending between said accelerator pedal and said crank means and comprising extensible and inextensible means which are linked serially, with the extensible means having sufficient resistance to extension such that the length of the motion transmitting means will remain relatively constant upon depression of the accelerator pedal until the point at which the throttle shaft has reached the wide open throttle position, whereupon the length of the extensible means will increase in response to further movement of the accelerator pedal such that such pedal movement will be unaccompanied by further rotation of the throttle shaft.

5. A throttle control system according to claim 4, in which said inextensible means comprises a flexible cable having one end attached to the accelerator pedal and another end attached to the crank means, with said extensible means comprising a cartridge which is operatively connected between said cable ends, with the cartridge having a resilient element and compression means housed therein such that movement of the accelerator pedal which is unaccompanied by further movement of the throttle shaft will cause compression of the resilient element.

6. A throttle control system according to claim 5, in which said resilient element comprises a spring.

7. A throttle control system according to claim 4, in which said accelerator pedal is mounted within a passenger compartment of said vehicle and the extensible means allows the accelerator pedal to rotate until it contacts a toe board within the compartment.

8. A throttle control system for an automotive vehicle, comprising:

an accelerator pedal;

a rotatable throttle shaft having a crank means and a throttle device affixed thereto, with said shaft being rotatable from an idle position to a wide open throttle position;

a spring means for biasing said crank means to an idle position;

stop means for engaging said crank means and for preventing further opening of the throttle device once the throttle shaft has reached the wide open throttle position; and motion transmitting means extending between said accelerator pedal and said crank means and comprising a flexible cable having one end attached to the accelerator pedal and another end attached to the crank means, and having resilient means interposed between and elastically connecting the first and second ends for controlling the length of the motion transmitting means, such that said length will remain relatively constant upon depression of the accelerator pedal until the point at which the throttle shaft has reached the wide open throttle position, whereupon the length of the resilient means will increase in response to further movement of the accelerator pedal such that such pedal movement will be unaccompanied by further rotation of the throttle shaft.

* * * * *